United States Patent [19]

Watanabe et al.

[11] Patent Number: 4,932,356

[45] Date of Patent: Jun. 12, 1990

[54] TONER CONTROL DEVICE

[75] Inventors: Satoshi Watanabe; Toshifumi Isobe; Yukio Okamoto, all of Hachioji, Japan

[73] Assignee: Konica Corporation, Tokyo, Japan

[21] Appl. No.: 276,419

[22] Filed: Nov. 23, 1988

[30] Foreign Application Priority Data

Dec. 4, 1987 [JP] Japan ..... 62-308257
Dec. 4, 1987 [JP] Japan ..... 62-305817
Dec. 11, 1987 [JP] Japan ..... 62-313562

[51] Int. Cl.[5] ..... G03G 21/00

[52] U.S. Cl. ..... 118/689; 355/208; 355/246

[58] Field of Search ..... 355/246, 208; 118/689, 118/690, 691

[56] References Cited

U.S. PATENT DOCUMENTS 4,671,646 6/1987 Florack et al. ..... 355/246
4,708,458 11/1987 Ueda et al. ..... 355/246 X
4,711,555 12/1987 Toshimitsu et al. ..... 355/299
4,743,372 5/1988 Takahashi ..... 355/246
4,758,861 7/1988 Nakamaru et al. ..... 355/246 X

*Primary Examiner*—Arthur T. Grimley
*Assistant Examiner*—Robert Beatty
*Attorney, Agent, or Firm*—Jordan B. Bierman

[57] ABSTRACT

An apparatus for developing a latent image formed on a photoreceptor constituted a container for storing developer, a toner feeder for replenishing toner, a sensor for measuring the toner concentration in the developer, a memory for storing a reference measurement lying only with a certain range and which is obtained by measuring a reference developer having a reference toner concentration by the sensor, and a controller for controlling a toner concentration of the current developer by operating the toner feeder so that a current measurement obtained by the sensor becomes equal to the reference measurement.

5 Claims, 8 Drawing Sheets

TONER CONTROL DEVICE

BACKGROUND OF THE INVENTION

This invention relates to an image formation device such as an electronic copier, more particularly to an image formation device which can control toner concentration accurately. An electronic copier is a device which forms an electrostatic latent image on a charged photoconductor (described hereinafter as a photosensitive drum) in accordance with manuscript information, changes it into a visible image with toner, and transfers and fixes this visible image on transfer paper. Recently, electronic copiers of this type are used in various industrial fields.

FIG. 11 is a block diagram which shows an electronic copier of this type. When the operator pushes a copier button (not shown), the device shown in the drawing starts the copying process. That is, a photosensitive drum 1 which rotates in the direction of the arrow is electrified by an electrode 3 after residual toner on the drum is removed by the blade in a cleaning section 2.

Next, electric charges on the unnecessary portion of the photosensitive drum 1 are removed by the electrostatic removing section 4.

The photosensitive region on the photosensitive drum 1 is exposed by the reflected light from manuscript 6 and an electrostatic latent image is formed on the drum surface. That is, a manuscript 6 irradiated by the light from the exposure section 5 which can move in the direction of the arrow as shown in the drawing, and the reflected light which contains the manuscript information reaches the photosensitive drum 1 via the mirrors M1 to M3 and lens system L, forming an electrostatic latent image on the drum surface by exposing the drum surface. This electrostatic latent image is converted into a visible image through the developing section 7 by absorbing toner. Then, the visible image on the drum surface is transferred to transfer paper (copy paper) at the transfer section 8. The transfer paper onto which the image is transferred is separated from the photosensitive drum 1 and sent to fixing rollers 10 by means of a transfer mechanism 9.

The transfer paper is heated by these fixing rollers 10 and the toner is fixed on the transfer paper, thus ending the copying process.

The section consisting of the mirrors M1, M2, and M3 and the above-mentioned exposure section 5 (the section surrounded by a broken line) constitutes the optical unit 20, which is designed to be movable in the direction of the arrow shown on the drawing by means of a movement mechanism (not shown).

Actually, the first mirror M1 and the exposure section 5 move at twice the speed the second and third mirrors, M2 and M3, in order to maintain the length of the optical path constant. Since light source 21 in the exposure unit 5 consists of, for example, a rod-like fluorescent lamp or halogen lamp which is set perpendicular to the manuscript surface, the optical unit 20 can scan the whole surface of manuscript 6.

The developing unit which is used in an electronic copier of this type employs a two-component developer consisting of the toner and carrier. Durability of this two-component developer deteriorates rapidly when toner concentration reaches a certain value. For example, in the case in which the toner concentrations are at 5% and at 2%, durability in the latter case may be half of the former case. For this reason, it is necessary to control the supply of toner so that toner concentration can be maintained at the desired value.

A toner amount detection system which uses inductance is available to detect toner concentration in a developing unit which employs two-component developer. This system utilizes the fact that the carrier included in the developer is a magnetic substance and detects toner concentration by arranging an inductance sensor which has a coil in the developing agent.

To say it concretely, the fact that the ratio of toner and carrier changes as toner concentration varies and permeability fluctuates is utilized, and toner concentration is obtained, by measuring permeability of the developing agent.

The output voltage of this inductance sensor is compared with the reference voltage, and toner is supplied so that output voltage of the inductance sensor becomes equal to the reference voltage, thus maintaining toner concentration constant.

By the way, output of the above-mentioned inductance sensor fluctuates, and it is necessary to adjust the output by variable resistors, etc. That is, the output voltage of the inductance sensor has to be adjusted to the predetermined value, when the reference concentration of toner is measured.

However, this adjustment may not be accurate. Accordingly, if the output voltage of the inductance sensor is not accurate, the toner concentration is controlled to erroneous values.

Also, when replacing the developing unit, the output voltage of the above-mentioned sensor had to be adjusted for each replaced developing unit, thus causing a lot of trouble.

SUMMARY OF THE INVENTION

This invention eliminates the above-mentioned problems. It aims at the realization of an image formation device which maintains concentration at an accurate and constant value.

An image formation device according to this invention is intended to eliminate the above problems, form an electrostatic latent image on the photoconductor, change it into a visible image by a developing agent, and transfer and fix this visible image onto transfer paper. It is characterized by a sensor which detects toner concentration of the developing agent; a non-volatile memory in which the reference value of toner concentration is written; a control means which controls toner concentration so the toner concentration, detected by the above-mentioned toner concentration detection sensor, becomes equal to the above noted reference value. The control means initially detects the toner concentration (which becomes the reference value for the toner concentration sensor), writes the detected value in a non-volatile memory, and controls toner concentration so the toner concentration, detected by the above-mentioned toner concentration detection sensor, becomes equal to the above reference value at the time of image formation.

Therefore, the toner concentration for the reference value is detected by the toner concentration sensor, and the detected value is written in the non-volatile memory. The toner concentration is controlled at the time of image formation so that the concentration detected by the above sensor becomes equal to the reference value.

The noted developing unit can be attached to the image formation device or be separate therefrom. The toner concentration sensor provides linear output in accordance the toner concentration when a toner of the predetermined color is used, and emit a low value output when toner of a color other than the predetermined color is used; so that the toner concentration of the developing agent having the predetermined color for the reference is detected by the toner concentration sensor and written in the non-volatile memory. If one of plural developing means is selectively mounted, the toner concentration, detected when the predetermined developing means is mounted, is written in the non-volatile memory.

DETAILED DESCRIPTION OF THE INVENTION

The example of this invention is described in detail by using the following drawings.

Figure 1:
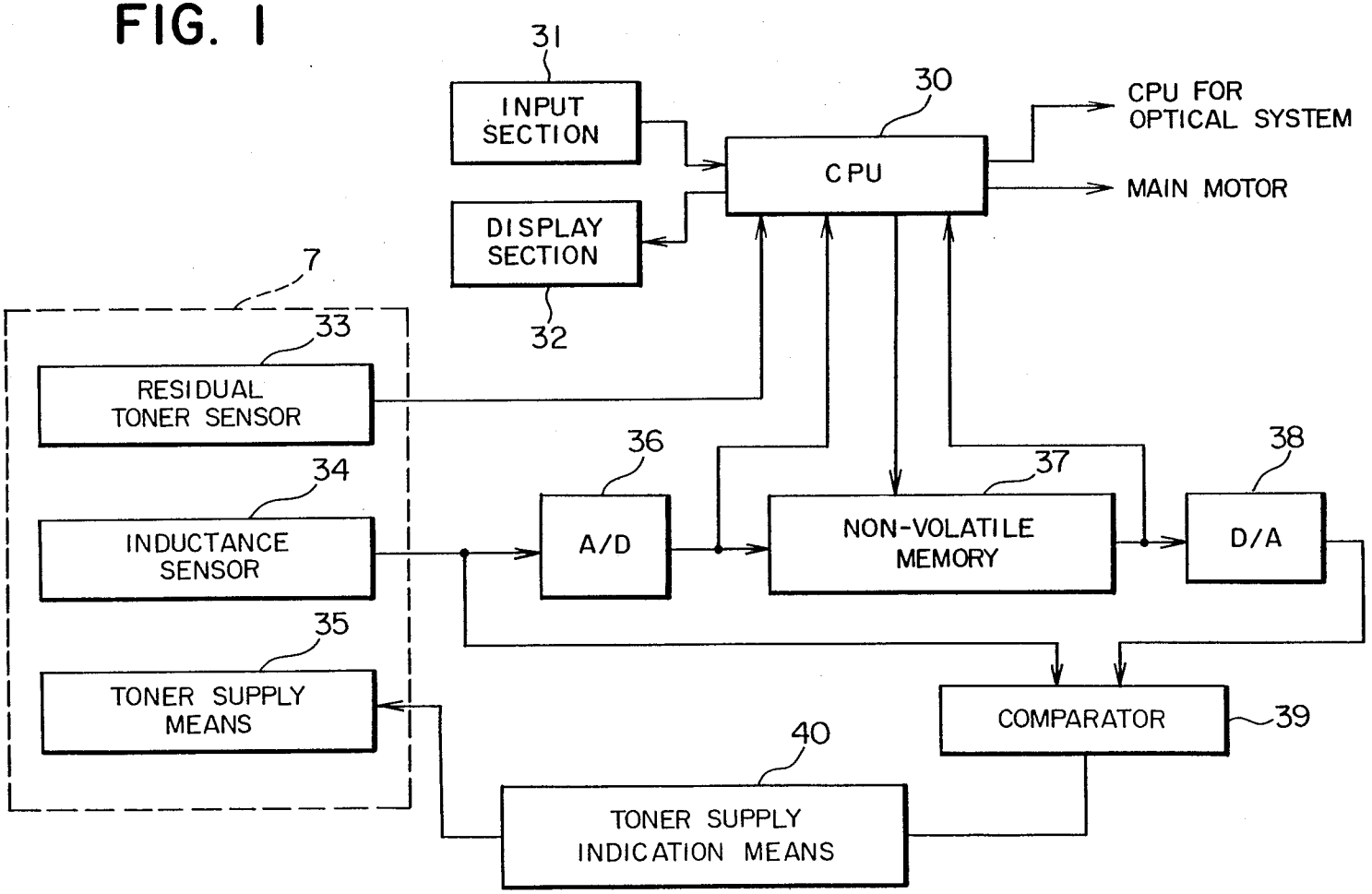
FIG. 1 is a block diagram showing an actual example, of this invention.

FIG. 1 is a block diagram which shows the electrical composition of an actual example of this invention.

In FIG. 1, the numeral 30 indicates the CPU which controls each section of the image formation device; 31 indicates the operation input section through which the operator inputs instructions, 32 indicates the display section to confirm the above input and display a message from the CPU 30; 33 indicates the residual toner sensor which is installed in the developing unit 7 and detects the amount of residual toner; 34 indicates the inductance sensor which measures permeability of the developing agent and outputs the appropriate voltage in accordance with toner concentration; 35 indicates a toner supply means which is installed in the developing unit 7 and supplies toner; 36 indicates the A/D converter which converts the value of the voltage detected by inductance sensor 34 in accordance with toner concentration into a digital value; 37 indicates the non-volatile memory in which the voltage value, corresponding to the voltage detected by the inductance sensor when the reference toner concentration is settled, is written in advance, and in which the toner concentration which is converted into a digital value by A/D converter 36 is written based on the instruction of the CPU 30, and from which the written toner concentration is read out; 38 indicates the D/A converter which converts the digital data of toner concentration from the non-volatile memory 37 into an analog value; 39 indicates a comparator which compares the voltage given from inductance sensor 34, in accordance with the toner concentration at the time of image formation, with the voltage stored in the non-volatile memory 37 in accordance with the reference toner concentration and which reads out the difference between these two inputs, and 40 indicates a toner supply instruction means which instructs the toner supply means 35 in accordance with the output voltage from the comparator 39.

Figure 2:
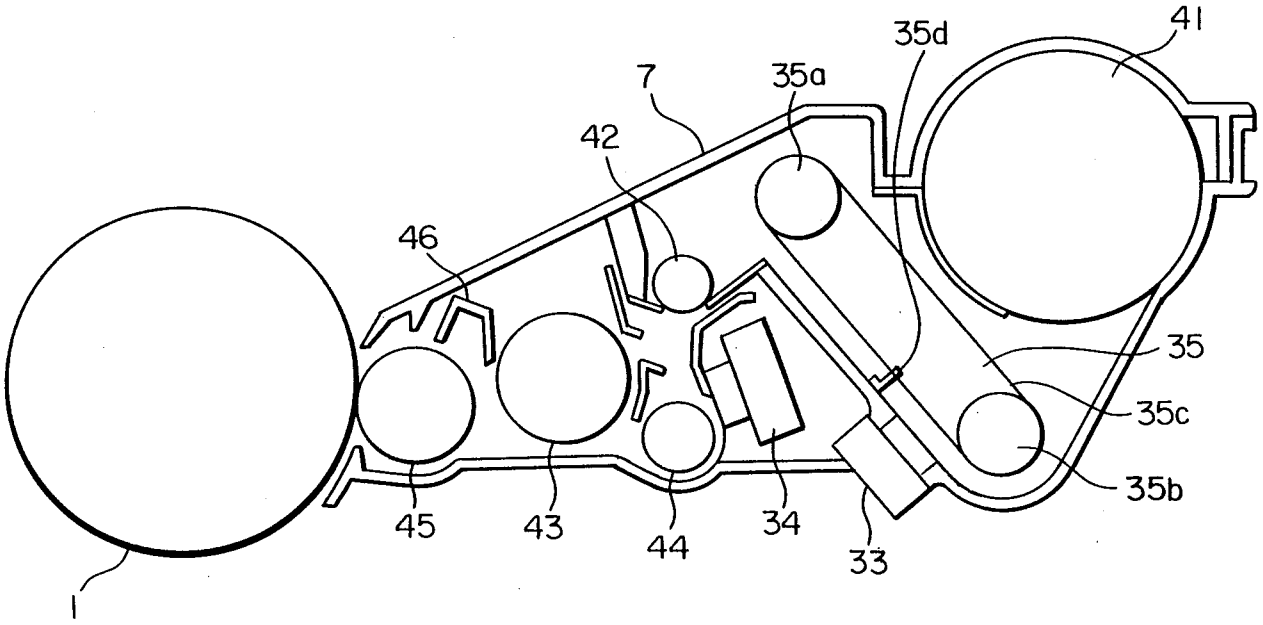
FIG. 2 shows the developing unit in cross section.

FIG. 2 shows a cross section which illustrates developing unit 7 with photosensitive drum 1. In this drawing, the same numbers are given to the same parts and units as in FIG. 1, and detailed descriptions are omitted. 1 indicates the photosensitive drum; 7 indicates the developing unit; 33 indicates the residual toner sensor which detects the amount of residual toner based on the vibration occurring when toner is supplied; 34 indicates the inductance sensor which detects toner concentration in the developing agent; 35 indicates the toner supply means; **35*a* and 35*b* indicate the rollers which are driven when toner is supplied; 35*c* indicates the belt which is driven by 35*a* and 35*b*; 35*d* indicates the carriage which is mounted on the belt 35*c* and supplies toner, 41 indicates a toner cartridge, 42 indicates the auxiliary roller which transfers toner supplied by the carriage 35*d*; 43 indicates the main stirring section which stirs the developing agent consisting of toner and carrier; 44 indicates the sub-stirring section which also stirs the developing agent; 45 indicates the developing sleeve which transfers toner to an electrostatic latent image on the photosensitive drum for development; and 46 indicates the magnetic brush regulating plate which regulates the height of the magnetic brush for the developing agent on sleeve 45**.

First, the operation of developing unit 7 is described. Toner which is supplied through the toner supply port is transferred to auxiliary roller 42 by the carriage **35*d* of the toner supply means 35 when a toner supply instruction is given. At this time, the residual toner sensor 33 detects the amount of residual toner based on the vibration which occurs when carriage 35*d* carries toner. Toner is dropped downward by the rotation of the auxiliary roller 42. Then, the developing agent (toner and carrier) which is in the developing unit and the above toner are stirred in the main stirring section 43 and sub-stirring section 44. Here, the inductance sensor 34 detects toner concentration by measuring the permeability of the developing agent. The magnetic brush of the developing agent is formed on the developing sleeve. The height of the brush is regulated by the brush regulating plate 46**, and the latent image on the photosensitive drum is developed by the developing agent which has passed the regulating plate and becomes the toner image.

This developing unit 7 can be readily mounted on or dismounted from the main body of the copier. The output of each sensor is supplied to CPU 30 via the connector which is connected when the developing unit is mounted on the main body of the copier (not shown). For this reason, it is possible to color copy with ease by interchanging the developing units which contain toners of different colors. As is described hereinafter, it is possible to identify the color of a developing unit mounted on the main body of the copier by connecting or opening any two terminals of the connector on the developing unit side.

The operation of this actual example is described using FIGS. 1 and 2 hereinafter.

First, it is expected to perform the following initialization initially or when an interchangeable developing unit is interchanged.

When the instruction for initialization is given from the operation input section 31, CPU 30 gives the instruction to stir the developing agent for a certain period of time (until the toner and carrier of the developing agent are mixed well, for example, 90 seconds) to the main stirring section 43 and sub-stirring section 44 of the developing unit 7. Initially, the developing agent having the reference concentration (for example, toner concentration of 4%) is poured into the developing unit. After the completion of stirring, the voltage, in accordance with the toner concentration of the reference-concentration developing agent, as measured by the inductance sensor 34, is converted into a digital value by means of A/D converter 36 and written into a non-volatile memory 37 based on the instruction of the CPU 30. Although the average value corresponding to the reference toner concentration is written in the non-volatile memory 37 in advance, it is rewritten into the accurate value by this initialization. When the writing into the non-volatile memory is completed, the initialization ends.

Figure 3:
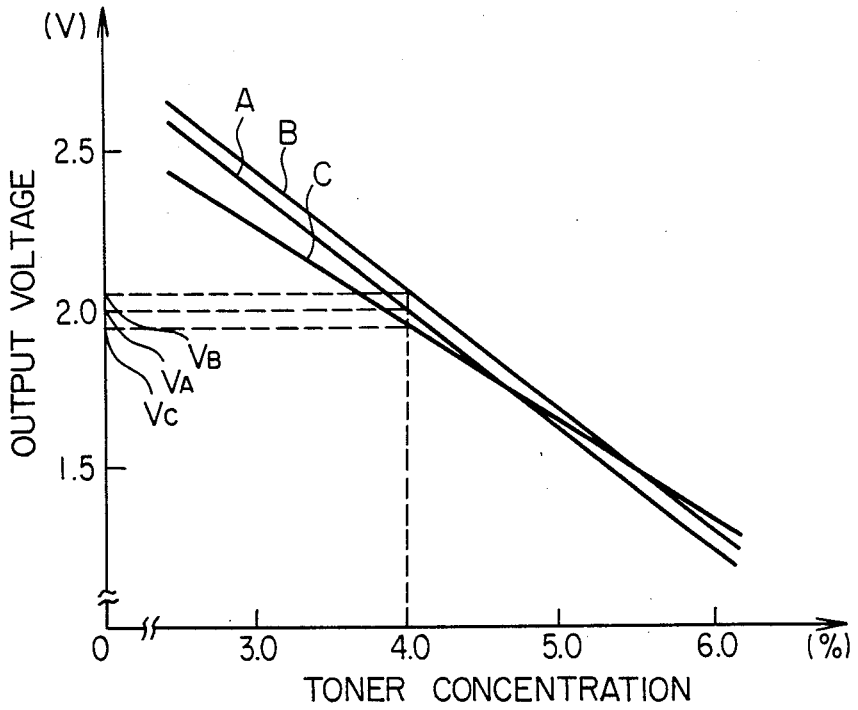
FIG. 3 is a drawing of an inductance sensor.

FIG. 3 is a drawing showing the inductance sensor of the developing unit into which black toner is poured. The characteristics for A, B, and C differ, and their output voltages for the same concentration differ (VA, VB, VC), though the sensors are of the same type. For this reason, the value written into the non-volatile memory differs slightly depending on the sensor used.

Figure 4:
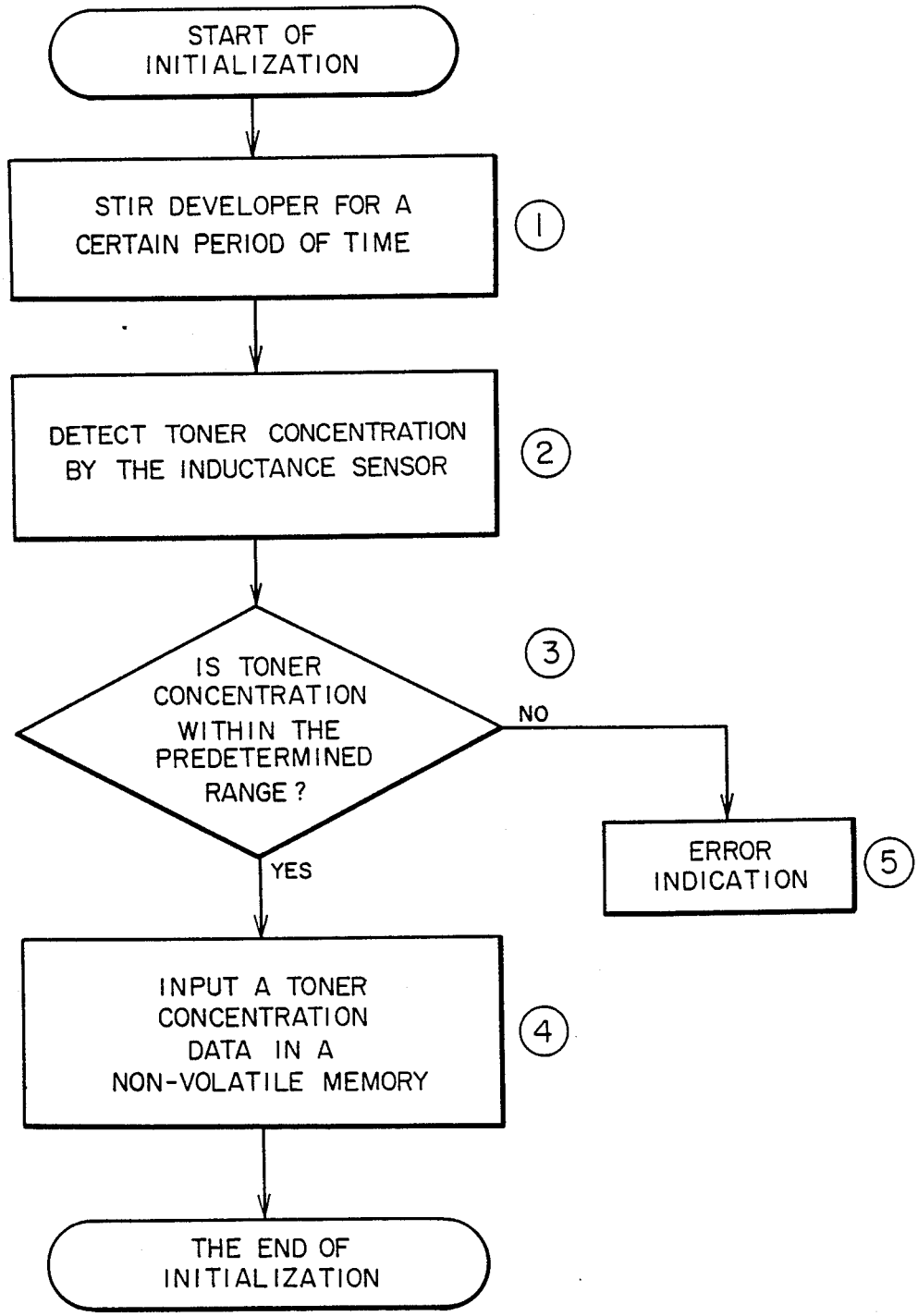
FIGS. 4 and 6 show flow charts illustrating the operation at the time of initialization.

Although the output voltage of this inductance sensor fluctuates minutely depending on the sensor, no great fluctuation occurs if toner concentration is within the reference concentration (for example, 4%). If a great fluctuation occurs, the sensor or A/D converter may be faulty, or the connectors may not be connected properly. If this abnormal value is written into the non-volatile memory 37, the toner concentration will be controlled based on this abnormal value at the time of image formation, and an inconvenience that the toner concentration is not controlled properly occurs. To eliminate the above disadvantage, as shown in FIG. 4, CPU 30 monitors toner concentration data which are converted into digital values after the developing agent is stirred (step (1)) and the toner concentration is detected (step (2)). If the value is normal, it is written into the memory, (step (4)), and when the output voltage deviates outside a certain range (expected fluctuation) which corresponds to the reference concentration, CPU judges its values as an abnormal value and does not allow the value to be written into the non-volatile memory 37. That is, if the output of A/D converter 36 exceeds the predetermined range, the CPU 30 does not give a signal to write it into the non-volatile memory 37. At the same time, CPU 30 indicates in the display section 32 that the initialization is not done because of the abnormality (step (5)). Thus, it is possible to prevent writing of an abnormal value into the non-volatile memory and to prevent a control based on an abnormal value at the time of image formation.

Figure 5:
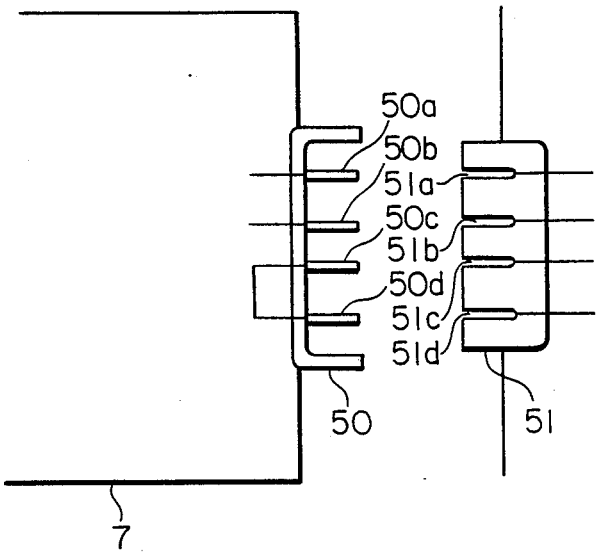
FIG. 5 shows a composition of a connector.

FIG. 5 is a block diagram which show an example of the means to identify the type of developing unit being used. The connectors, 50 and 51, are mounted on the developing unit 7 side and the main body of the copier respectively. When the developing unit 7 is mounted on the main body of the copier, the terminals of the connector 50, 50*a*, 50*b*, 50*c*, and 50*d*, and the terminals of the connector 51, 51*a*, 51*b*, 51*c*, and 51*d*, are connected respectively. In this type of connector, for example, if the developing unit contains black toner, terminals 50*c* and 50*d* are short-circuited. In the case of the developing unit containing toner other than black, terminals 50*c* and 50*d* are open. By connecting the terminals 51*c* and 51*d* to CPU 30 and monitoring between both terminals, it is possible to identify the type of developing unit.

Even in the case in which toners of different colors are put in several interchangeable developing units and one of these developing units is used depending on the service condition, the toner most frequently used is black. And, in the case of toner other than black, the latitude for toner concentration is great, and deviation of toner concentration to some extent is tolerated. For this reason, it is sufficient that the data on the reference concentration of black toner is written into the non-volatile memory 37. In such a case, if a developing unit containing a toner other than black is mounted at the time of initialization, this toner concentration is written into the non-volatile memory 37, and accurate control of toner concentration becomes impossible even when the developing unit containing black toner is remounted at the time of image formation. To prevent this inconvenience, this invention does not allow the writing of toner concentration into the non-volatile memory 37 when the developing unit containing toner other than black toner is mounted. In this example, writing into the non-volatile memory is done only when the terminals 51*c* and 51*d* are conducting.

Figure 6:
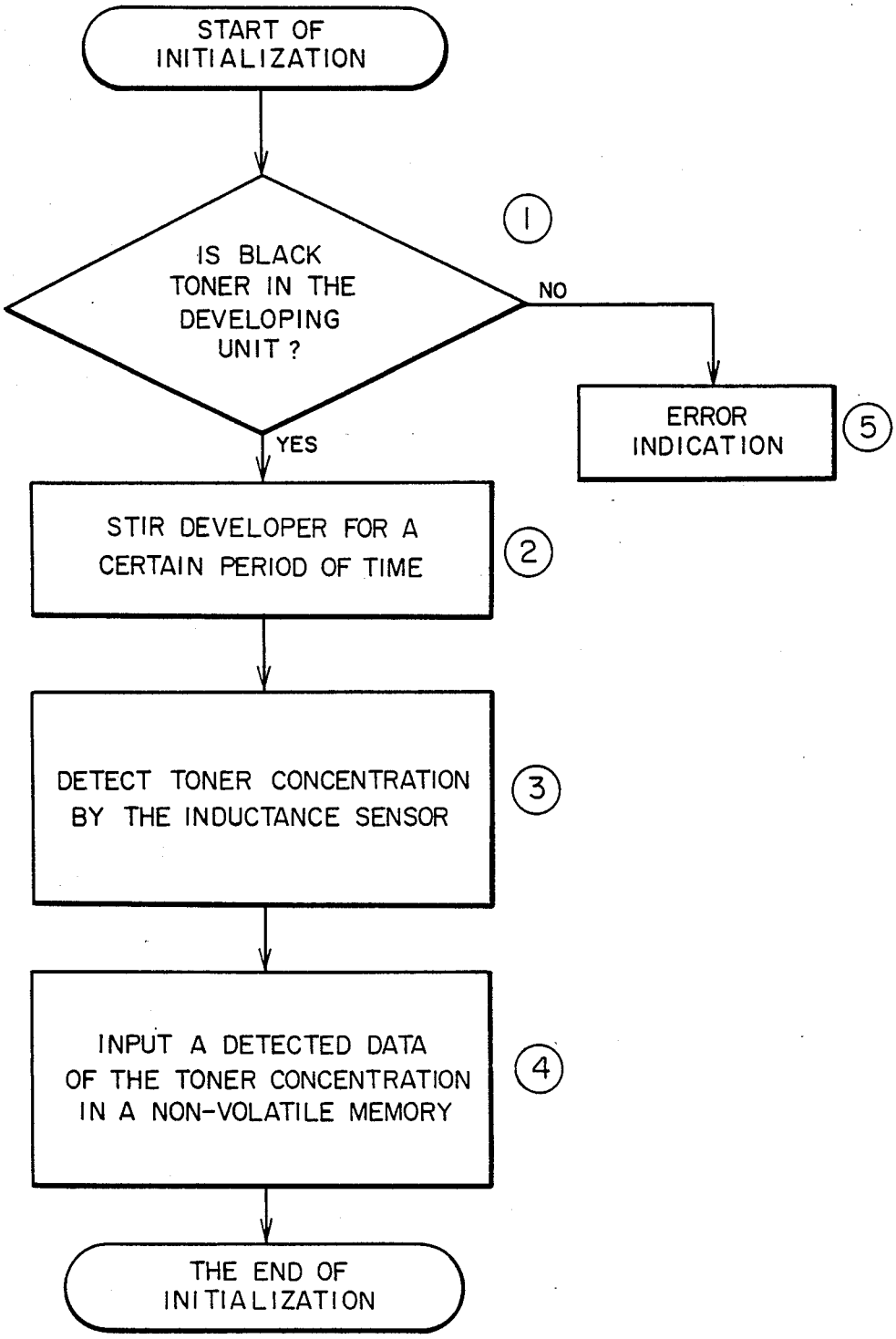

As is shown in FIG. 6, CPU 30 monitors the type of developing unit to be mounted (step (1)) and performs stirring (step (2)), detection of toner concentration (step (3)), and writing into a non-volatile memory (step (4)), when the developing unit containing black toner is mounted. If a developing unit containing a toner other than black is mounted, CPU 30 does not give a signal to write into the non-volatile memory 37. At the same time, CPU 30 displays an error (step (5)) in the display section 32 that initialization is not done because of the wrong type of developing unit mounted, thus preventing the writing of an abnormal value into the non-volatile memory and the control based on the abnormal value at the time of image formation.

Further, since data is written into the non-volatile memory 37 in advance, toner is supplied based on the value written in the non-volatile memory, even if an image is formed without the above-mentioned initialization. Also, if the non-volatile memory is rewritten at the time of initialization, toner is supplied based on the rewritten value.

Next, the operation of the toner concentration control at the time of image formation (copying) will be described.

When a copy instruction is given to the operation input section 31, CPU 30 gives the copy instruction to each related section. Based on these instructions, processes such as charging of the photosensitive drum, formation of a latent image by exposure, development which makes this latent image absorb toner, and transfer and fixation on transfer paper are actuated. At this time, toner in the developing agent is used, and toner concentration decreases gradually. Accordingly, it is necessary to supply toner to the developing agent.

The output detected by the inductance sensor 34 is applied to one input terminal of the comparator 39. Also, the voltage, which is detected by the sensor at the reference toner concentration and is written in the non-volatile memory 37, is applied to the other input terminal of the comparator 39.

The comparator 39 compares the voltages applied to both input terminals and emits a voltage in accordance with the difference between the above two voltages. The toner supply instruction means 40 gives an instruction whether or not toner needs to be supplied to the toner supply means 35 in developing unit 7 based on the output from the comparator 39. The toner supply means 35 supplies toner to the developing agent based on the above instruction. Thus, the toner concentration in the developing agent increases, and toner is supplied until the toner concentration coincides with the reference value.

As shown in FIG. 3, since the toner concentration and the output voltage of the inductance sensor 34 provide an approximate direct proportion, it is possible to make the toner supply instruction, based on the results of the comparison of the above voltage with the reference value of the reference toner concentration, change proportionally and to vary the speed, of toner supply by the toner supply means.

Figure 7:
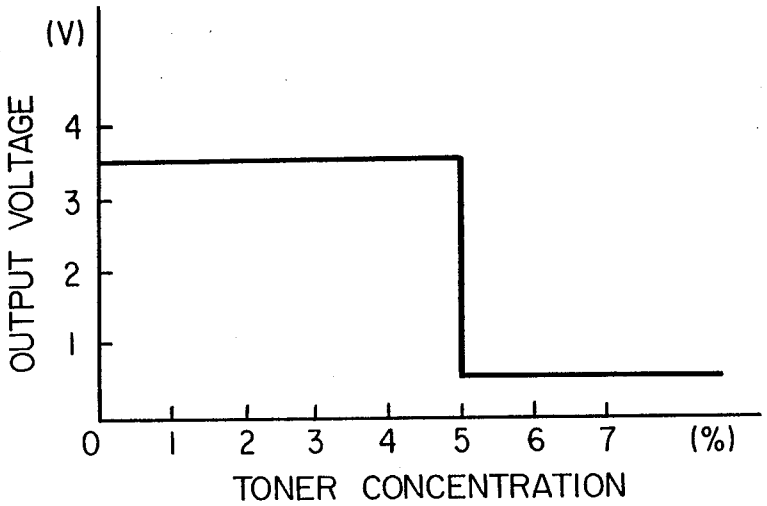
FIG. 7 is an output drawing of the inductance sensor of the developing unit which contains color toner.

The output voltage of the inductance sensor of the developing unit containing black toner is shown in FIG. 3 and in FIG. 7, the output characteristics of the inductance sensor of the developing unit containing a color toner are set to output a high level and a low level of voltage divided by the reference toner concentration (for example, 5%) of the color toner. Here, the high level voltage is set to a larger value than the value written in the non-volatile memory at the time of initialization (reference value) and the low level voltage is set to a smaller value than the above reference value. Since the above reference value fluctuates slightly as is shown in FIG. 3, it is necessary to set the high/low levels of voltage with an allowance.

Figure 8:
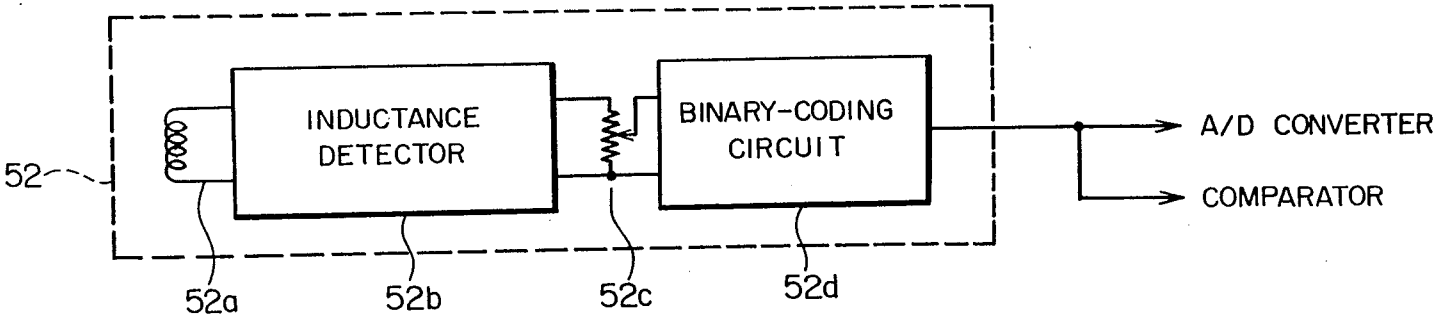
FIG. 8 is a block diagram showing the inductance sensor of the developing unit continuing color toner

FIG. 8 is a block diagram which shows the inductance sensor 52 of the developing unit into which color toner is poured. The inductance sensor 52 may be located on the main body of the image formation device or elsewhere in the same way as the inductance sensor 34. The inductance detector **52*b* outputs a voltage corresponding to the toner concentration according to the inductance variation of the coil 52*a*. This voltage based on the toner concentration is converted into high level or low level voltage by means of the binary-coding circuit 52*d*. The switching timing of these two voltages concerning toner concentration is adjusted by the variable resistor 52*c***.

By providing an inductance sensor having these characteristics, color toner is smoothly supplied in the same way as in the case of black toner, and an adjustment of the inductance sensor also becomes easy. That is, such adjustment, that makes the output voltage of the inductance sensor 52 coincide with the value written in the non-volatile memory 37 concerning the reference concentration of color toner, becomes unnecessary, and merely the switching between the high and low levels of voltage at the reference concentration of color toner is sufficient.

As described above, it is possible to create an image formation device which can maintain toner concentration at a constant and accurate value by writing a toner concentration of the reference developing agent at the initialization step and supplying toner based on the comparison between the current toner concentration at the image formation and the reference toner concentration which is read from the memory.

As described above in detail, according to this invention, it is possible to realize an image formation device which maintains toner concentration at an accurate and constant value by writing the toner concentration of the reference developing agent into a non-volatile memory at the time of initialization and supplying toner based on the comparison between the current toner concentration at the image formation and the reference toner concentration which is read from the memory. Also, according to this invention, it is possible to provide an image formation device which can keep toner concentration accurate for each developing unit even when developing units are interchanged.

Next, another example for the control of toner concentration will be described. This device is provided with means to measure the toner concentration in the developing agent, means to hold the data of measured concentration, and means to control the concentration of the above toner and in which the measured concentration data of the toner having a known concentration is held in the above data holding means. The data of concentration obtained from the above measuring means is corrected by the thus held data: and the toner concentration is controlled by the above control means based on the corrected data.

Figure 9:
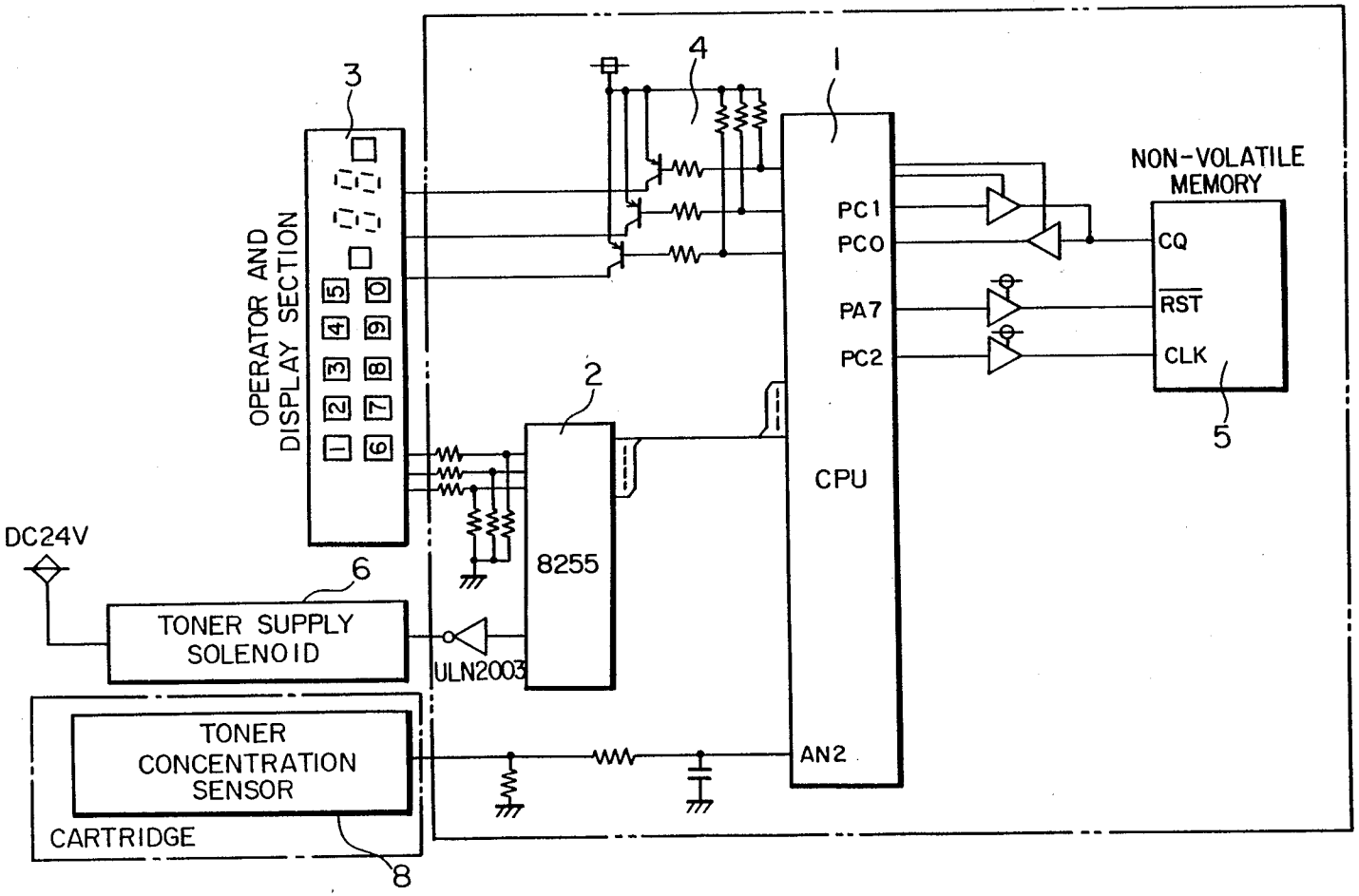
FIG. 9 is a circuit diagram showing another example of the toner concentration control circuit according to this invention.

FIG. 9 shows a toner control circuit of one example. 1 indicates a CPU, 2 indicates I/O expander which uses 8255, 3 indicates operation and display section having a key switch and display element, 4 indicates a display driver for the operation and display section 3, 5 indicates a non-volatile memory, 6 indicates a toner supply solenoid which is installed in the toner hopper section of a developing unit, and 8 indicates the toner concentration sensor mounted in cartridge.

When developing agent having the predetermined concentration is put in cartridge in which the toner concentration sensor 8 is built and the instruction "data set" for the toner concentration sensor 8 is given through the operation and display section 3, the developing agent is stirred for the predetermined period of time, and then the concentration data from the toner concentration sensor 8 is taken through the terminal AN2 of CPU 1 for internal A/D conversion, and the data of concentration is written into non-volatile memory 5.

According to this example, output data of the toner concentration sensor in the ordinary copying operation is corrected by processing in CPU 1 as follows, and the toner supply solenoid 6 is driven by the data from the toner concentration sensor after this correction.

$$V_{ADJ}=V_S+(V_O-V_{STR}) \quad (1)$$

$V_{ADJ}$: Data of toner concentration sensor after correction $V_S$: Data of toner concentration sensor before correction $V_O$: Reference data of toner concentration sensor at the predetermined toner concentration (a constant)

$V_{STR}$: Data of toner concentration sensor set in a non-volatile memory

Figure 10:
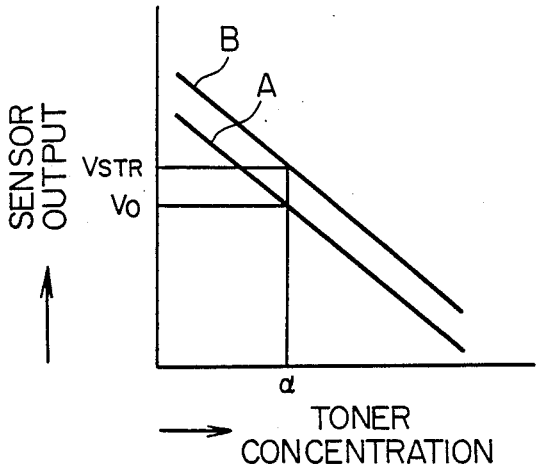
FIG. 10 is an output drawing of a toner concentration sensor which is used in the actual example in FIG. 9.
Figure 11:
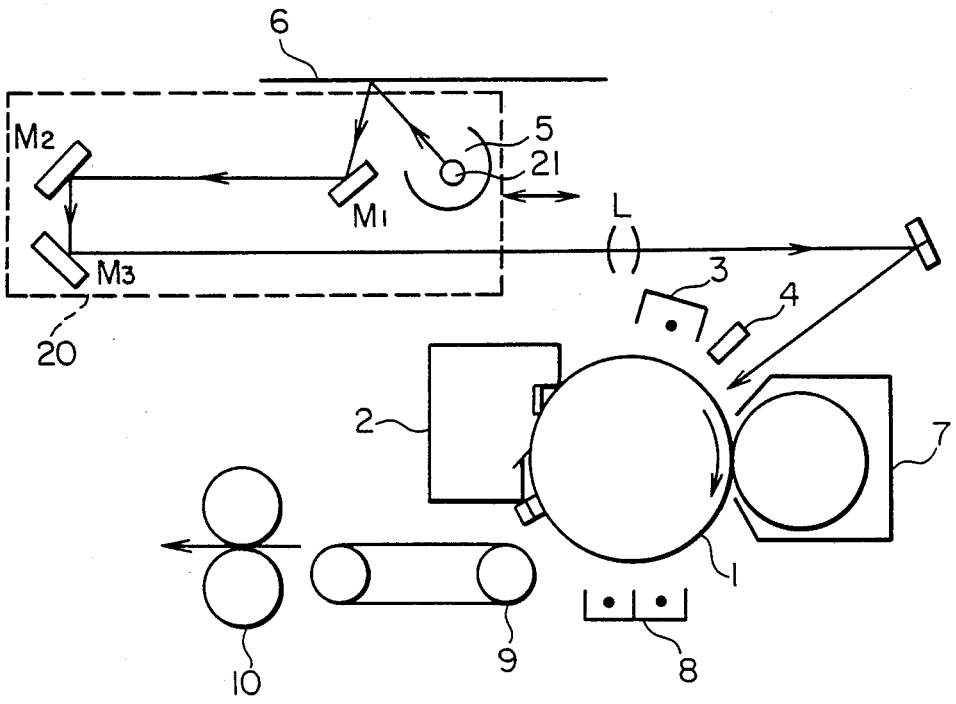
FIG. 11 is a block diagram of a conventional electronic copier.

The relation between toner concentration and the output of sensor 8 is as outlined in FIG. 10. The reference output line of the sensor is as shown by A, and the output is Vo (a constant) at the known toner concentration $\alpha$.

However, as has been described previously, the output of the sensor shapes the output line B in FIG. 10 due to fluctuation, and the output of this sensor becomes $V_{STR}$ at the concentration $\alpha$.

Since a difference between output lines A and B is obtained by $(V_O - V_{STR})$, the output of the sensor can be maintained on the line A by correcting output $V_S$ of the sensor at an arbitrary toner concentration by the difference $(V_O - V_{STR})$.

Accordingly, if the sensor output data $V_{STR}$ at the known toner concentration is set in a non-volatile memory 5, it is possible to correct the unevenness of the sensor output by the equation (1) at all times.

As a result, it becomes possible to control the concentration based on the output line of A, irrespective of unevenness of the sensor output, thus eliminating the necessity of adjusting mechanisms such as a variable resistor.

Also, it is possible to know the deviation of the current value from the sensor reference value by displaying the data $V_{STR}$ (or the figures, characters, or symbols corresponding thereto) in non-volatile memory 5, and to know the current toner concentration by displaying the concentration data after correction or the figure, character, in similar fashion.

Furthermore, if an abnormality is displayed when the deviation from the reference data obtained by the sensor exceeds a certain range, it is possible to recognize the sensor malfunction.

Furthermore, when the connector which connects the toner concentration sensor and the control section is disconnected, analog input AN2 into the terminal of CPU 1, becomes 0 V. Thus, by detecting this, it is possible to detect disconnection of the connector.

Furthermore, it is possible to arbitrarily change the target value of the toner concentration by setting data into the non-volatile memory 5.

According to this invention, an adjusting circuit such as a variable resistor for correcting uneven output from the toner concentration measuring medium becomes unnecessary, and reduction of production cost and adjustment steps, can be realized, since the results of the toner concentration measurement at the known toner concentration are inputted into the data holding medium such as non-volatile memory, the data from the toner concentration measuring medium is adjusted by this data, and toner concentration based on the data after the adjustment is controlled by a CPU.

What is claimed is:

1. An apparatus for developing a latent image formed on a photoreceptor comprising a container for storing toner;

a toner feeder for replenishing toner in said container;

a detector for obtaining a measurement value of toner concentration;

a memory for storing an original reference value of toner concentration;

a control for controlling toner concentration of a current developer by operating said toner feeder based on a comparison between the reference value and a measurement value of toner concentration of the current developer, said memory adapted to replace said original reference value with a new reference value which is obtained by said detector measuring a reference developer having a reference toner concentration; and said control adapted to check the new reference value so that, when the new reference value is within a predetermined range, said control allows replacement of the original reference value with the new reference value, and when the new reference value is outside of the predetermined range, said control does not allow replacement of the original reference value by the new reference value.

2. The apparatus of claim 1, wherein said memory stores a temporary reference data in advance to storing the reference measurement.

3. The apparatus of claim 1, wherein said container, said toner feeder and said detector are located in a developing unit and there are provided a plurality of said developing units for storing a plurality of colors of developer, and wherein the reference measurement obtained by a predetermined developing unit is written in said memory.

4. The apparatus of claim 3, wherein said detector disposed in a developing unit storing a predetermined color outputs a linear signal proportional to the toner concentration and another detector disposed in a developing unit storing a color other than the predetermined color outputs a high-low signal corresponding to toner concentration.

5. The apparatus of claim 1, wherein said control means corrects the current measurement on the basis of the reference measurement and controls the toner concentration on the basis of the corrected current measurement.

* * * * *